United States Patent [19]

Fife et al.

[11] Patent Number: 4,960,471

[45] Date of Patent: Oct. 2, 1990

[54] CONTROLLING THE OXYGEN CONTENT IN TANTALUM MATERIAL

[75] Inventors: James A. Fife, Douglassville; Robert A. Hard, Oley, both of Pa.

[73] Assignee: Cabot Corporation, Waltham, Mass.

[21] Appl. No.: 412,419

[22] Filed: Sep. 26, 1989

[51] Int. Cl.[5] ..... C21D 1/00

[52] U.S. Cl. ..... 148/20.3; 148/126.1

[58] Field of Search ..... 148/126.1; 75/0.5 B, 75/0.5 BB, 13.1, 133

[56] References Cited

U.S. PATENT DOCUMENTS 4,722,756 2/1988 Hard ..... 148/126.1

*Primary Examiner*—Stephen J. Lechert, Jr.

[57] ABSTRACT

A process for controlling the oxygen content in tantalum material comprising heating the material under a hydrogen-containing atmosphere in the presence of a getter composite comprising a getter metal encapsulated in tantalum.

8 Claims, No Drawings

CONTROLLING THE OXYGEN CONTENT IN TANTALUM MATERIAL

FIELD OF THE INVENTION

The present invention relates generally to the control of the oxygen content in tantalum materials and particularly to the control, under a hydrogen-containing atmosphere, of oxygen in tantalum. Such materials are especially suitable for capacitor production.

BACKGROUND OF THE INVENTION

Capacitors typically are manufactured by compressing powders, e.g. tantalum, to form a pellet, sintering the pellet in a furnace to form a porous body, and then subjecting the body to anodization in a suitable electrolyte to form a continuous dielectric oxide film on the sintered body.

Development of tantalum powders suitable for capacitors has resulted from efforts by both capacitor producers and powder processors to delineate the characteristics required of tantalum powder in order for it to best serve in the production of quality capacitors. Such characteristics include surface area, purity, shrinkage, green strength, and flowability.

For tantalum capacitors, the oxygen concentration in the tantalum pellets is critical. For example, when the total oxygen content of porous tantalum pellets is above 3000 ppm (parts per million), capacitors made from such pellets may have unsatisfactory life characteristics. Unfortunately, the tantalum powders used to produce these pellets have a great affinity for oxygen, and thus the processing steps which involve heating and subsequent exposure to air inevitably result in an increased concentration of oxygen. In the production of capacitor grade tantalum powder, electronic grade tantalum powder is normally heated under vacuum to cause agglomeration of the powder while avoiding oxidation of the tantalum. Following this heat treatment, however, the tantalum powder usually picks up a considerable amount of additional oxygen because the initial surface layer of oxide goes into solution in the metal during the heating and a new surface layer forms upon subsequent exposure to air thereby adding to the total oxygen content of the powder. During the later processing of these powders into anodes for capacitors, the dissolved oxygen may recrystallize as a surface oxide and contribute to voltage breakdown or high leakage current of the capacitor by shorting through the dielectric layer of amorphous oxide. Accordingly, the electrical properties of tantalum capacitors would be markedly improved if the oxygen content could be controlled, i.e., decreased, maintained about constant or increased within acceptable limits.

One technique which has been employed to deoxidize tantalum powder has been through the mixing of alkaline earth metals, aluminum, yttrium, carbon, and tantalum carbide with the tantalum powder. However, there are certain disadvantages to this technique. The alkaline earth metals, aluminum, and yttrium form refractory oxides which must be removed, e.g., by acid leaching, before the material is suitable for capacitors. With respect to carbon, the amount of carbon must be carefully controlled since residual carbon is also deleterious to capacitors even at levels as low as 50 ppm. Still, other methods which have been proposed involve using a thiocyanate treatment or using a hydrocarbon or reducing atmosphere during some of the tantalum processing stages in order to prevent oxidation and thus keep the oxygen content low.

Another process scheme proposed in U.S. Pat. No. 4,722,756 (Hard) for the control of the oxygen content of tantalum and columbium materials provides for heating the material in an atmosphere containing hydrogen gas in the presence of a metal more oxygen active than tantalum or columbium, e.g. titanium or zirconium. However, a disadvantage of the Hard process is that the metals utilized in controlling the oxygen content may contaminate the tantalum or columbium material.

OBJECTS AND SUMMARY OF THE INVENTION

It is an object of the present invention to provide a method for controlling the oxygen content in tantalum materials.

It is a further object of this invention to provide a method for controlling the oxygen content in tantalum materials without contaminating the tantalum materials.

The present invention provides a method for controlling the oxygen content in tantalum material by heating the material to a temperature of about 900° C. to about 2400.C under a hydrogen-containing atmosphere in the presence of a getter composite having an affinity for oxygen greater than that of the tantalum material. The getter composite comprises a getter metal, which is more oxygen active than the tantalum material, encapsulated in tantalum. During heating, the oxygen from the tantalum material passes through the encapsulating tantalum to the getter metal resulting in oxidation of the getter metal. As a result, the oxygen content of the tantalum material is controlled while direct physical contact and contamination of the tantalum material by the getter metal is avoided.

According to a preferred embodiment of the invention, the getter composite is located in close proximity to the tantalum material being heated. In one embodiment, the getter composite is embedded in the tantalum material and is employed in a physical form which facilitates easy separation and removal from the tantalum material. In all embodiments, the weight ratio of the getter metal in the getter composite to the tantalum material is preferably chosen such that under appropriate process conditions, the oxygen content of the tantalum material is controlled to within a desired level. In practice, the amount of getter metal used with the tantalum material generally exceeds the stoichiometric amount required to react with the total available oxygen in the tantalum material.

DETAILED DESCRIPTION OF THE INVENTION

The present invention is directed to a method for controlling the oxygen content, i.e., decreasing or maintaining the oxygen content about constant, or minimizing the amount of oxygen pick-up, of tantalum material when subjected to a thermal cycle, e.g., heat treatment of tantalum powder, sintering of tantalum capacitor pellets, annealing of wire and foil and the like. According to the method of the present invention, the tantalum material is heated to temperatures ranging from about 900° C. to about 2400° C., preferably from about 1100° C. to about 2000° C. and more preferably from about 1300° to about 1600° C., under a hydrogen containing atmosphere in the presence of a getter composite that exhibits high reactivity to oxygen while avoiding contamination of the tantalum material.

According to the invention, the getter composite comprises a getter metal encapsulated in tantalum in such a way as to prevent direct contact of the getter metal with the tantalum material subjected to heat treatment.

Suitable getter metals include beryllium, calcium, cerium, hafnium, lanthanum, lithium, praseodymium, scandium, thorium, titanium, uranium, vanadium, yttrium, zirconium, alloys thereof such as misch metals, mixtures thereof, and the like. The preferred getter metals are titanium and zirconium. In the absence of the tantalum encapsulation, these getter metals would contaminate the tantalum material at the temperatures employed during the heat treatment.

The getter metal may be employed in any physical form, such as a sheet, sponge, powder, turnings, etc., provided it can be encapsulated by tantalum. In a preferred embodiment, the getter composite comprises a tantalum enclosure, such as a tube, box or any other structure having a cavity capable of including and sealing the getter metal therein. In one embodiment, the getter composite is formed by sealing getter metal in a tantalum tube. In another embodiment, the getter metal is enclosed in a box made from tantalum sheet metal. In either of these embodiments, the tantalum enclosure is preferably not completely filled with the getter metal. The space provided in the enclosure allows for expansion of the getter metal as it oxidizes during the heat treatment of the tantalum material.

It has been discovered that the tantalum enclosure behaves as an excellent one-way conductor, allowing oxygen to pass from the less oxygen active material, in this case, the tantalum material, to the more oxygen active material, i.e., the getter metal, while preventing the getter metal vapors generated in the tantalum enclosure during the heat treatment process from passing through the enclosure thereby avoiding contamination of the tantalum material with the getter metal.

It has been discovered that controlling the oxygen content in tantalum material by the process of the present invention is affected by a number of variables including temperature, hydrogen pressure, heat treatment time and type of getter metal employed. It has also been discovered that the rate of oxygen transfer between the tantalum material and the getter composite can be increased by minimizing the wall thickness of the tantalum enclosure encapsulating the getter metal. The preferred wall thickness of the tantalum enclosure is from about 0.0002 to about 0.001 inch, more preferably about 0.0004–0.001 inch. Although thinner gauge walls may be employed there is a practical limitation as to how thin the walls could be made without affecting the integrity of the enclosure. Factors which determine the thickness of the tantalum enclosure walls include the conditions under which the heat treatment process is conducted, the getter metal employed, and the proximity of the getter composite to the tantalum material. For example, some getter metal may have substantial vapor pressures at the heat treatment temperatures, which would necessitate greater wall thicknesses to prevent rupturing of the tantalum enclosure and subsequent contamination of the tantalum material.

Preferably, the getter composite is in physical contact with the tantalum material. Depending on the weight of the tantalum material surrounding the getter composite and the temperature at which the process is conducted, the wall thickness of the tantalum enclosure would be adjusted to afford the enclosure sufficient strength to prevent collapsing or rupturing.

The use of the getter composite during heat treatment of the tantalum material overcomes the problem of foreign metal or elemental contamination of the tantalum material thereby preserving the usefulness of the tantalum material for capacitor production.

In order to evaluate tantalum powder treated according to the present invention, oxygen and getter metal, titanium content i.e., were determined prior to and subsequent to heat treatment. The procedures for determining the oxygen and titanium content are as follows:

A. Determination Of Oxygen Content

The oxygen content of the tantalum may be determined using a Leco TC-30 Oxygen Nitrogen Analyzer, Leco #760-414 Graphite Crucibles, manufactured and sold by Leco Corporation, St. Joseph, MI, and nickel foil, 2 inches wide by 0.025 inch thick. The nickel foil was cut into 1 inch by 1 inch squares, cleaned and formed into capsules. Samples (0.2 g) were transferred to each capsule and the capsules closed and crimped into the smallest possible volume. The Leco TC-30 Oxygen Nitrogen Analyzer was first calibrated using blank and tantalum standards of known oxygen content, then the samples were run through the analyzer to generate ppm oxygen.

B. Determination of Titanium Content

Samples of tantalum metal to be analyzed for titanium are first converted to the oxide by ignition in a muffle furnace. 150 mg of this oxide is mixed with 75 mg of a buffer containing graphite (33%), silver chloride (65%), and germanium oxide (2%) and placed in high purity graphite sample electrodes. The electrodes are excited with a d-c arc at 220 volts and 15 amperes. The spectra is recorded photographically and referred to analytical curves to determine the appropriate elemental concentrations.

This method provides for the determination of titanium in tantalum by measurement of the spectral intensity at a wave length of 3078.65 Angstroms using a Baird 3 meter spectrograph. The range of concentrations that can be quantified by this instrument is 5 to 500 ppm.

The following example is provided to further illustrate the invention. The Example is intended to be illustrative in nature and is not to be construed as limiting the scope of the invention.

EXAMPLE

A series of experiments were conducted to study the effect of utilizing a getter composite to control the oxygen content of tantalum powder. Tantalum powder samples for the first three experiments were chosen from the same feedstock having an initial oxygen content of 2705 ppm and an initial titanium content of less than 5 ppm.

All three samples were heat treated in the presence of a getter composite comprising titanium getter metal wrapped in tantalum foil having a thickness of 0.0004. In each instance, the getter metal was included in an amount which exceeds the stoichimetric amount necessary to react with the total oxygen content in the tantalum powder. The getter composite was situated adjacent to the tantalum powder in a heat treatment furnace. The three samples along with the getter composite were heat treated under a hydrogen atmosphere at varying pressures and at varying temperatures as shown in Table I. The heat treatment time for all three samples was 1 hour.

In more detail, a getter composite was placed in close proximity to three samples of tantalum powder and thereafter heated in a furnace under vacuum to 1050° C. and held for approximately 30 minutes until the powder outgassing was completed and the furnace pressure had decreased to less than one micron.

After the outgassing was completed, the furnace was backfilled with hydrogen to the pressure shown in Table I. The furnace temperature was then increased to the heat treatment temperature shown in Table I and the resulting temperature was held for 1 hour. Thereafter, the hydrogen was evacuated from the furnace and the furnace cooled.

The fourth sample was selected from a different feedstock than the first three samples and used as a control. The sample was heated in the same manner as the other three samples except that the titanium getter metal was not enclosed in a tantalum foil. Before heat treatment, this sample had a titanium content of less than 5 ppm content and an oxygen of about 1220 ppm. This sample was run to provide a measure of the level of getter metal contamination of the tantalum powder when processed using conventional getter metal without the benefit of tantalum encapsulation.

The results of all four experiments are shown in Table I below. The data clearly reflects that the oxygen content of the tantalum powder can be controlled without contaminating the tantalum powder when utilizing the getter composite according to the present invention.

TABLE 1

| Experiment Number | Heat Treat. Temperature (°C.) | Hydrogen Pressure (mmHg) | Final Oxygen (ppm) | Oxygen Pick-Up (ppm) | Final Ti Content (ppm) |
|---|---|---|---|---|---|
| 1 | 1500 | 368 | 2440 | −265 | <5 |
| 2 | 1500 | 710 | 1895 | −810 | 5 |
| 3 | 1400 | 710 | 2725 | −20 | <5 |
| 4 (CONTROL) | 1450 | 9 | 1280 | +60 | 200 |

The data from experiments 1–3 shows that the encapsulated getter metal functions to control oxygen content while further serving to avoid any appreciable contamination of the tantalum material by the titanium getter metal.

The data from the control experiment shows that titanium performs well as an oxygen getter metal, but, without encapsulation, contaminates the tantalum material.

As will be apparent to those skilled in the art, the present invention may be embodied in other forms or carried out in other ways without departing from the spirit or essential characteristics of the invention.

What is claimed is:

1. A process for controlling the oxygen content in tantalum material comprising heating said material at a temperature ranging from about 900° C. to about 2400° C. under a hydrogen-containing atmosphere in the presence of a getter composite comprising a getter metal encapsulated in tantalum wherein said getter metal is more oxygen active than the tantalum material.

2. The process of claim 1, wherein said getter metal is selected from the group consisting of titanium, zirconium, calcium, cerium, hafnium, lanthanum, lithium, praseodymium, scandium, thorium, uranium, vanadium, yttrium and mixtures thereof.

3. The process of claim 1, wherein said getter metal is encapsulated in tantalum formed to have a cavity capable of including and sealing the getter metal.

4. The process of claim 2, wherein said getter metal is titanium or zirconium.

5. The process of claim 1 wherein the tantalum material is heated at a temperature ranging from about 1100° C. to about 2000° C.

6. The process of claim 1, wherein the tantalum material is heated at a temperature ranging from about 1300° C. to about 1600° C.

7. The process of claim 1, wherein the getter composite is in physical contact with the tantalum material.

8. The process of claim 3, wherein said tantalum is tantalum foil having a thickness from about 0.0002 to about 0.001.

* * * * *